US011628318B1

(12) United States Patent
Wedding et al.

(10) Patent No.: US 11,628,318 B1
(45) Date of Patent: Apr. 18, 2023

(54) BLOWER ASSEMBLY FOR A POWERED AIR-PURIFYING RESPIRATOR

(71) Applicant: E.D. Bullard Company, Cynthiana, KY (US)

(72) Inventors: William Chad Wedding, Lexington, KY (US); Paul A. Kinzer, Georgetown, KY (US)

(73) Assignee: E.D. Bullard Company, Cynthiana, KY (US)

( * ) Notice: Subject to any disclaimer, the term of this patent is extended or adjusted under 35 U.S.C. 154(b) by 120 days.

(21) Appl. No.: 17/380,550

(22) Filed: Jul. 20, 2021

Related U.S. Application Data

(60) Provisional application No. 63/053,821, filed on Jul. 20, 2020.

(51) Int. Cl.
*A62B 7/10* (2006.01)
*F04D 29/70* (2006.01)
(Continued)

(52) U.S. Cl.
CPC ..... *A62B 7/10* (2013.01); *F04D 17/08* (2013.01); *F04D 27/00* (2013.01);
(Continued)

(58) Field of Classification Search
CPC . A62B 7/10; F04D 17/08; F04D 17/16; F04D 29/4226; F04D 29/664701
See application file for complete search history.

(56) References Cited

U.S. PATENT DOCUMENTS 4,430,995 A * 2/1984 Hilton ..... A61M 16/0069 128/205.12
5,413,097 A * 5/1995 Birenheide ..... A62B 7/10 128/206.17
(Continued)

FOREIGN PATENT DOCUMENTS

JP S63180030 * 7/1988

OTHER PUBLICATIONS

ACI Sensors, "Tech Tips Episode #2—Calculating Air Flow Volume with Pressure Transmitters", Mar. 6, 2019, YouTube, https://www.youtube.com/watch?v=eTFQWN8qdZ4 (Year: 2019).*
(Continued)

*Primary Examiner* — Woody A Lee, Jr.
*Assistant Examiner* — Brian O Peters
(74) *Attorney, Agent, or Firm* — Stites & Harbison, PLLC; David W. Nagle, Jr.; Gary N. Stewart

(57) ABSTRACT

A blower assembly for a powered air-purifying respirator (PAPR) assembly includes: a lower housing; an upper housing connected to the lower housing, such that the upper housing and the lower housing collectively define a first interior cavity; a filter configured to filter ambient air drawn into the blower assembly; and a fan. The upper housing and the filter define a pathway for a flow of air into the first interior cavity. The fan is positioned in the first interior cavity such that, when the fan is activated, ambient air is drawn into the blower assembly and travels along the pathway into the first interior cavity for subsequent delivery out of the blower assembly. The lower housing defines an outlet port for directing breathable air out of the blower assembly for delivery to a user (e.g., via a breathing tube interconnecting a headpiece and the outlet port).

19 Claims, 11 Drawing Sheets

(51) Int. Cl.

| | |
|---|---|
| ***F04D 17/08*** | (2006.01) |
| ***F04D 27/00*** | (2006.01) |
| ***F04D 29/42*** | (2006.01) |
| ***A62B 18/08*** | (2006.01) |

(52) U.S. Cl.
CPC ..... *F04D 29/4226* (2013.01); *F04D 29/701* (2013.01); *A62B 18/08* (2013.01)

(56) References Cited

U.S. PATENT DOCUMENTS

| | | | | |
|---|---|---|---|---|
| 5,549,104 | A * | 8/1996 | Crump ..... | A62B 18/04 128/201.25 |
| 9,453,513 | B2 * | 9/2016 | Chen ..... | F04D 17/16 |
| 2009/0314295 | A1 | 12/2009 | Hatmaker | |

OTHER PUBLICATIONS

E.D. Bullard Company, EVA Series User Manual, Aug. 25, 2020.

* cited by examiner

BLOWER ASSEMBLY FOR A POWERED AIR-PURIFYING RESPIRATOR

CROSS-REFERENCE TO RELATED APPLICATIONS

The present application claims priority to U.S. Patent Application Ser. No. 63/053,821 filed on Jul. 20, 2020, the entire disclosure of which is incorporated herein by reference.

BACKGROUND OF THE INVENTION

The present invention relates to a blower assembly for a powered air-purifying respirator (PAPR), which filters and removes contaminants from ambient air and then directs breathable air to a headpiece worn by a user via a breathing tube.

In a typical PAPR, a blower assembly includes a centrifugal fan (or impeller) that is driven by a motor to draw in ambient air through an air-purifying filter, such as a High Efficiency Particulate Air (HEPA) filter, or a gas cartridge. Such filters or cartridges remove contaminants, with breathable air then being delivered via a breathing tube to a headpiece worn by the user.

SUMMARY OF THE INVENTION

The present invention is a blower assembly for a powered air-purifying respirator (PAPR) assembly.

An exemplary blower assembly made in accordance with the present invention includes: a lower housing; an upper housing connected to the lower housing, such that the upper housing and the lower housing collectively define a first interior cavity; a filter configured to filter ambient air drawn into the blower assembly; and a fan. The upper housing and the filter define a pathway for a flow of air into the first interior cavity, and the fan is positioned in the first interior cavity so that, when the fan is activated, ambient air is drawn into the blower assembly and travels along the pathway defined by the filter and the upper housing into the first interior cavity for subsequent delivery to a user. The lower housing defines an outlet port for directing breathable air out of the blower assembly for delivery to a user (e.g., via a breathing tube interconnecting a headpiece and the outlet port).

The filter is removably secured to the upper housing, and, in some embodiments, includes: a frame member that defines a second interior cavity; a filter media positioned in the second interior cavity; and a lid including one or more openings (or vents) to allow air to pass through the lid and into the second interior cavity. In one particular embodiment, the upper housing defines a first central opening and the frame member defines a second central opening that is in registry with the first central opening, such that the first central opening and the second central opening define a passageway for air flow into the first interior cavity. As a result of such configuration, when activated, the fan draws ambient air through the lid, through the second interior cavity, through the second central opening, through the first central opening, and into the first interior cavity for subsequent delivery through the outlet port.

In some embodiments, the blower assembly further includes a ring which is positioned within the first interior cavity and circumscribes the fan. Preferably, the ring is positioned at a spaced distance from the fan, such that the ring effectively bifurcates the first interior cavity into a high-pressure zone and a low-pressure zone, with the high-pressure zone corresponding to an area of the first interior cavity located inside of the ring and the low-pressure zone corresponding to an area located outside of the ring. To enable breathable air drawn into the first interior cavity by the fan to travel from the high-pressure zone to the low-pressure zone for subsequent delivery through the outlet port, the ring is preferably constructed of a porous material that allows air to pass through it. The ring, in some embodiments, may also be constructed of a noise-suppressing material, such as a melamine foam.

In some embodiments, the blower assembly further includes a subassembly that can be utilized to calculate volumetric air flow within the first interior cavity across the ring at a given time. The subassembly includes: a first pressure sensor that is positioned and configured to obtain air pressure readings in the high-pressure zone; a second pressure sensor that is positioned and configured to obtain air pressure readings in the low-pressure zone; and a controller that is operably connected to the first pressure sensor and the second pressure sensor. Air pressure readings obtained from the first pressure sensor and the second pressure sensor are utilized by the controller to calculate volumetric air flow within the first interior cavity. In some embodiments, the controller is operably connected to the fan and is configured to communicate instructions which adjust the speed of the fan based on the volumetric flow rate calculated from the air pressure readings obtained by the first pressure sensor and the second pressure sensor.

In some embodiments, the lower housing includes a tubular extension which defines the outlet port through which air is directed out of the blower assembly, such as to a breathing tube connected thereto. To facilitate rapid and simple connection (or disconnection of) the breathing tube, in some embodiments, the blower assembly further includes a clip mounted to the tubular extension which can be selectively engaged to disconnect the breathing tube from the tubular extension.

DETAILED DESCRIPTION OF THE INVENTION

The present invention is a blower assembly for a powered air-purifying respirator (PAPR) assembly.

Figure 1A:
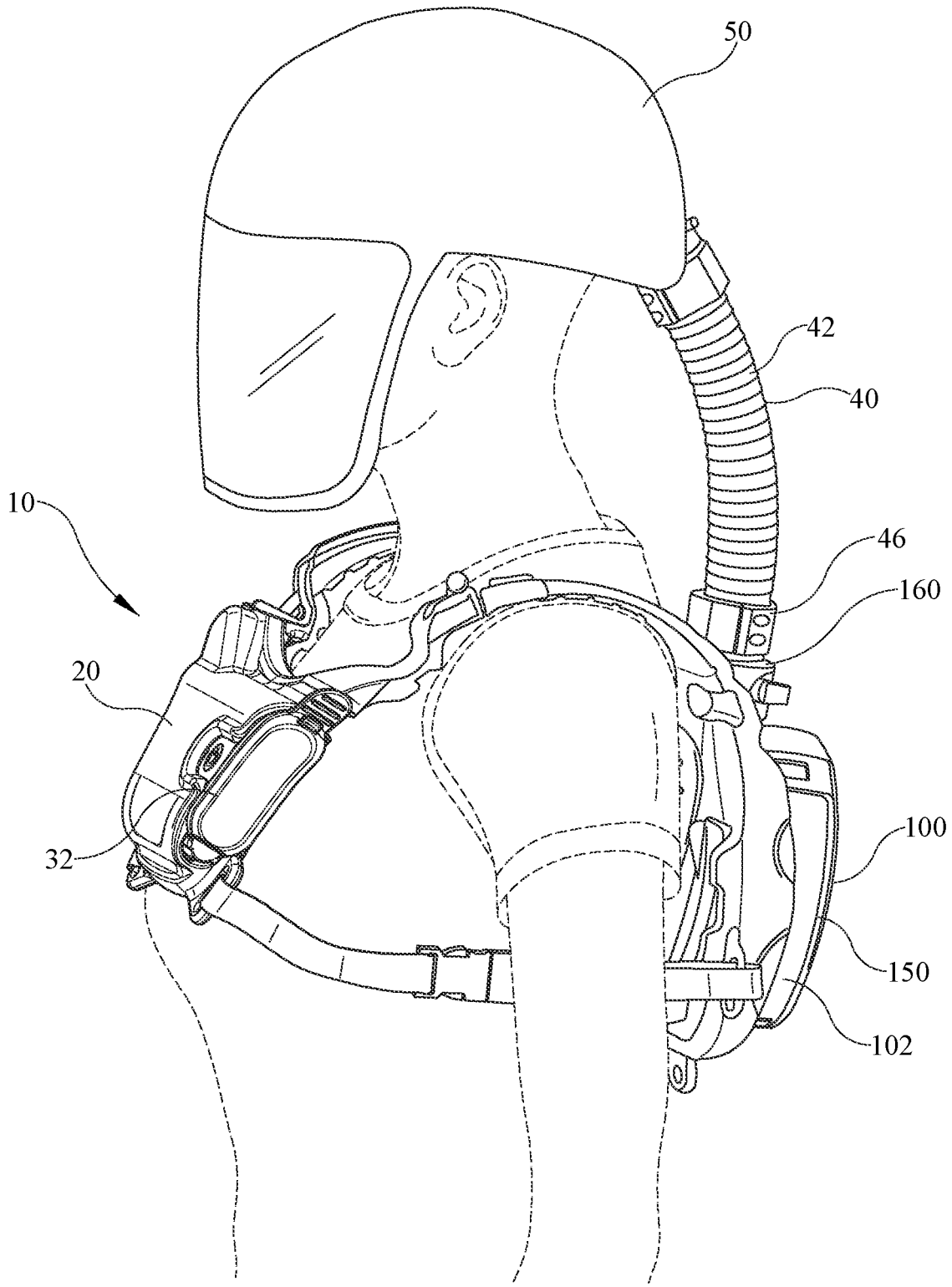
FIG. 1A is a perspective view of a PAPR carriage and assembly, including an exemplary blower assembly made in accordance with the present invention, being worn by a user.
Figure 1B:
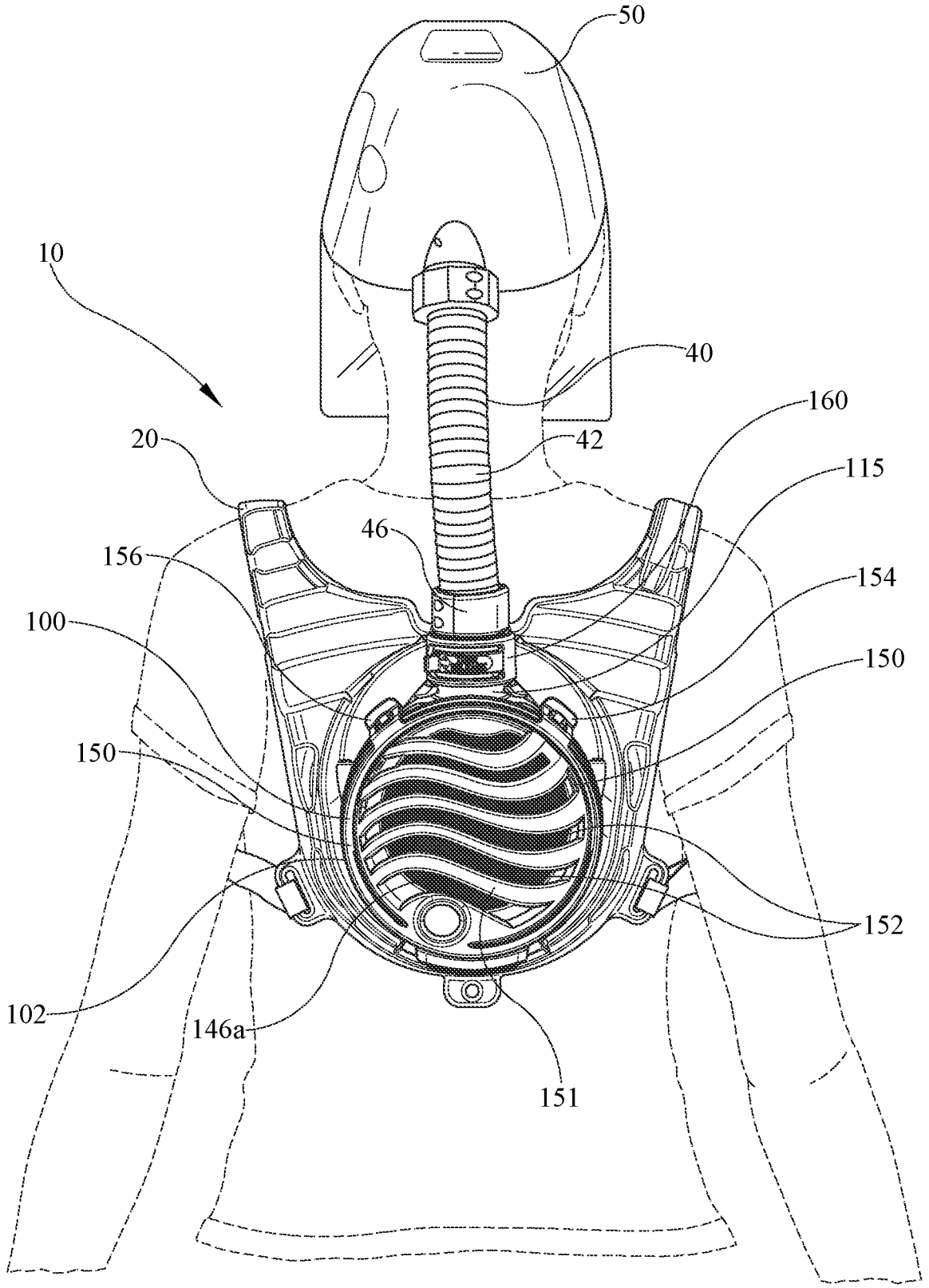
FIG. 1B is a rear view of the PAPR carriage and assembly of FIG. 1A being worn by a user.

FIGS. 1A-B are various views of a PAPR carriage and assembly 10, including a blower assembly 100 made in accordance with the present invention.

Figure 2:
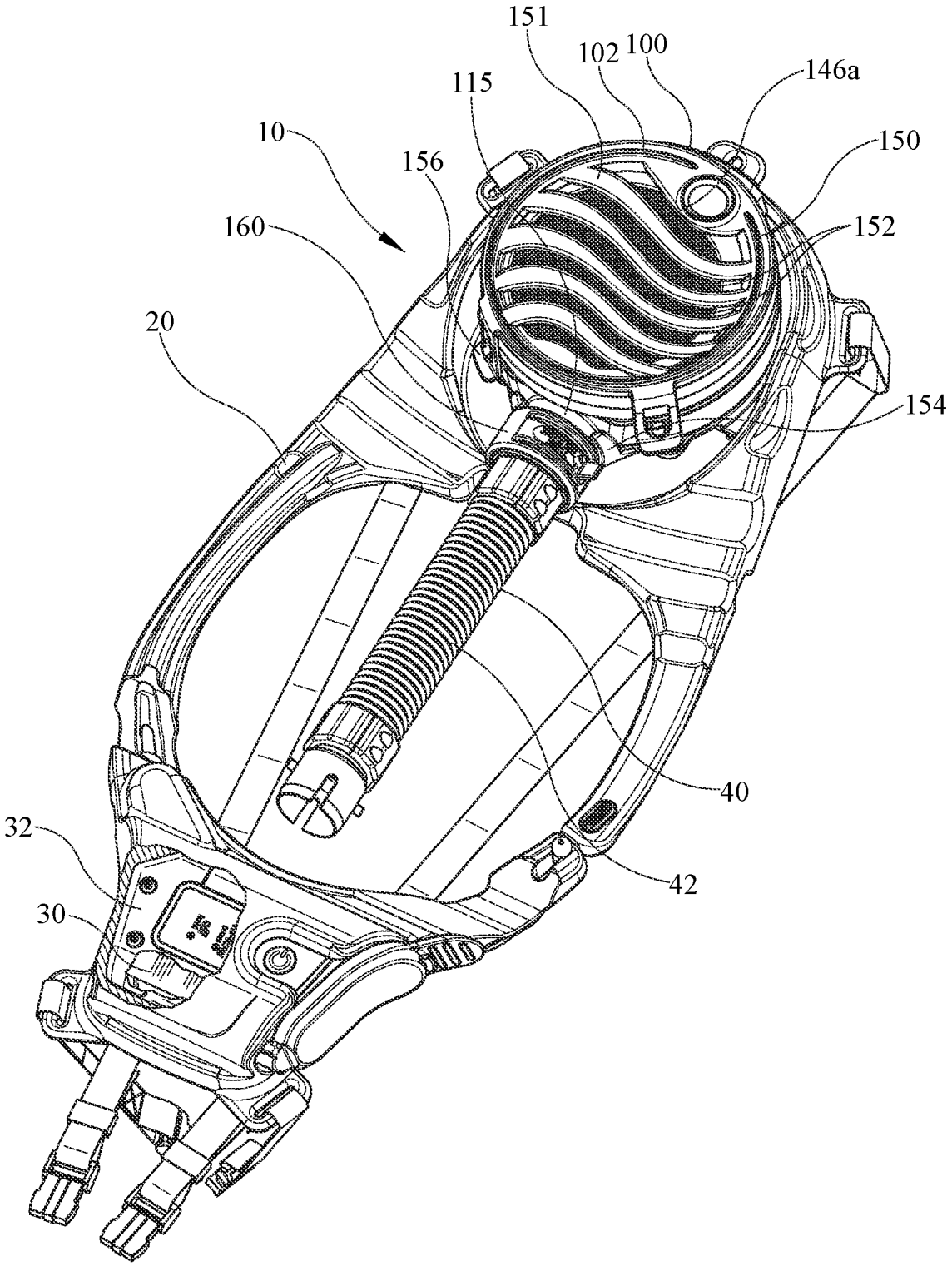
FIG. 2 is a perspective view of the PAPR carriage and assembly of FIG. 1A in isolation.

FIG. 2 is a perspective view of the PAPR carriage and assembly 10 of FIG. 1A.

As shown in FIGS. 1A-B and 2, the exemplary blower assembly 100, which is configured to generate breathable air and is the focus of the present application, can be utilized in conjunction with a carriage 20 and a power source 30 (FIG. 2), which, in this case, is housed within a power source housing 32, to form the PAPR carriage and assembly 10. The PAPR carriage and assembly 10 is configured to be connected to a headpiece 50 by a breathing tube 40, so that breathable air generated by the blower assembly 100 is directed to the headpiece 50 via the breathing tube 40. In this case, the headpiece 50 only partially covers the user's head. It is appreciated, however, that other headpiece types or designs (hoods, masks, etc.) that are designed to provide the user with filtered air may alternatively be used without departing from the spirit or scope of the present invention.

Referring still to FIGS. 1A-B and 2, in this exemplary embodiment, the carriage 20 of the PAPR carriage and assembly 10 includes a main body, which is formed to drape over the shoulders of a user when worn so that the weight of the blower assembly 100 and the power source 30 is borne by the shoulders of the user. The main body of the carriage 20, in this case, includes two cavities configured to receive the power source 30 and the blower assembly 100, such that when the PAPR carriage and assembly 10 is assembled and the carriage 20 is worn (i.e., the PAPR carriage and assembly 10 is in use), the blower assembly 100 and the power source 30 are positioned on opposing anterior and posterior sides of the user, as best shown in FIG. 1A. Accordingly, in use, the carriage 20 causes the weight of the blower assembly 100 and the power source 30 of the PAPR carriage and assembly 10 to be borne by and distributed across the upper body of the user in a counterbalanced manner as opposed to being isolated to a single area around the waist of the user, as is generally the case of belt-based PAPRs of known construction. One carriage, power source, and power source housing suitable for use with the blower assembly 100 of the present invention is described in commonly assigned and co-pending U.S. patent application Ser. No. 17/358,227, which is incorporated herein by reference.

As noted above, however, the focus of the present application is on the blower assembly 100 itself. Indeed, the exemplary blower assembly 100 described herein could be mounted on various carriages, belts, or other support structures to deliver breathable air to a user without departing from the spirit and scope of the present invention.

Figure 3:
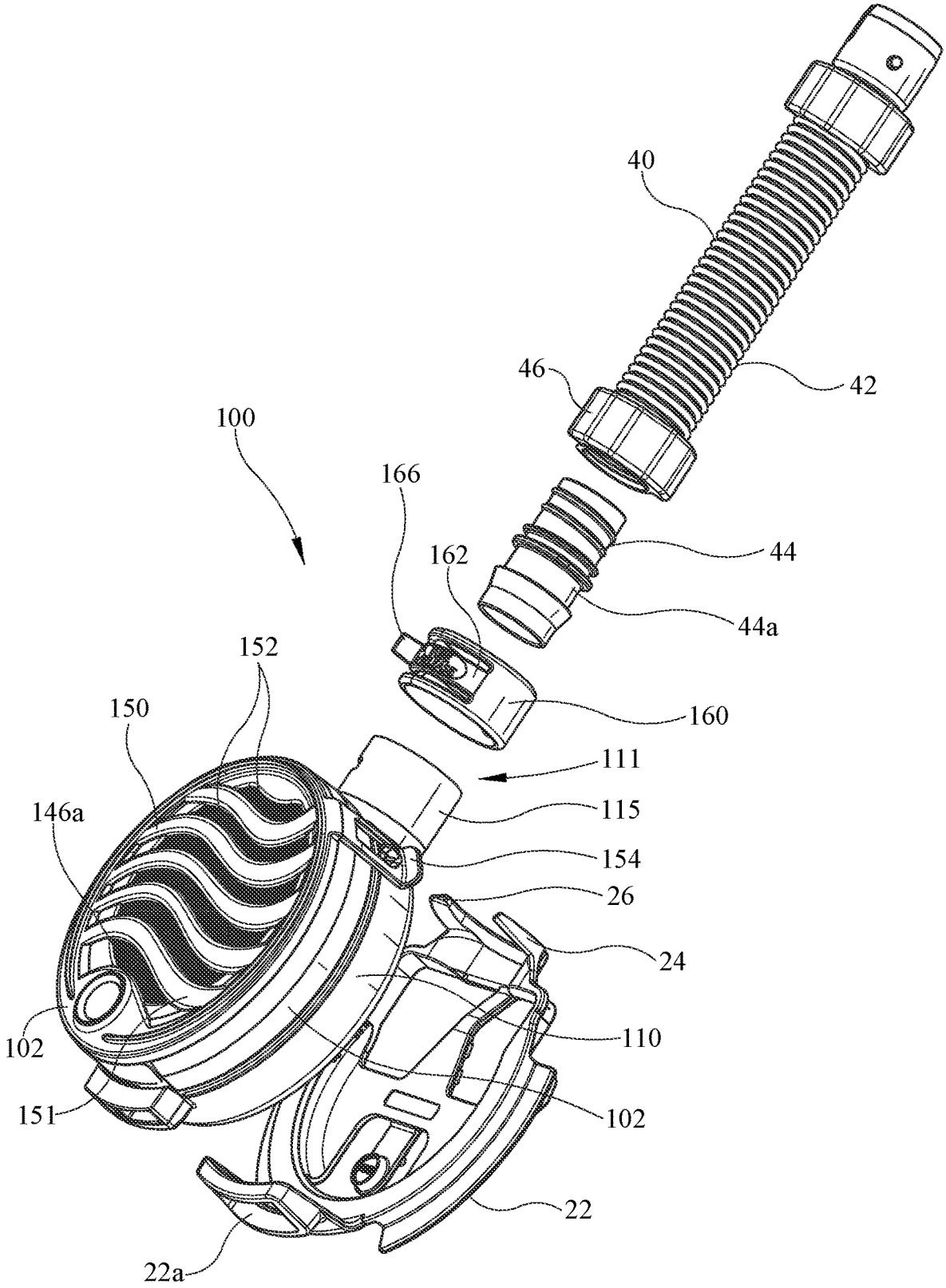
FIG. 3 is a perspective view of the exemplary blower assembly, a cradle, and a breathing tube of the PAPR carriage and assembly of FIG. 1A, where the breathing tube and the exemplary blower assembly are disassembled to better illustrate certain features of such components.

FIG. 3 is a perspective view of the blower assembly 100, a cradle 22 of the carriage 20, and the breathing tube 40 of the PAPR carriage and assembly 10 of FIG. 1A, where the breathing tube 40 and the blower assembly 100 are disassembled to better illustrate certain features of such components.

Figure 4:
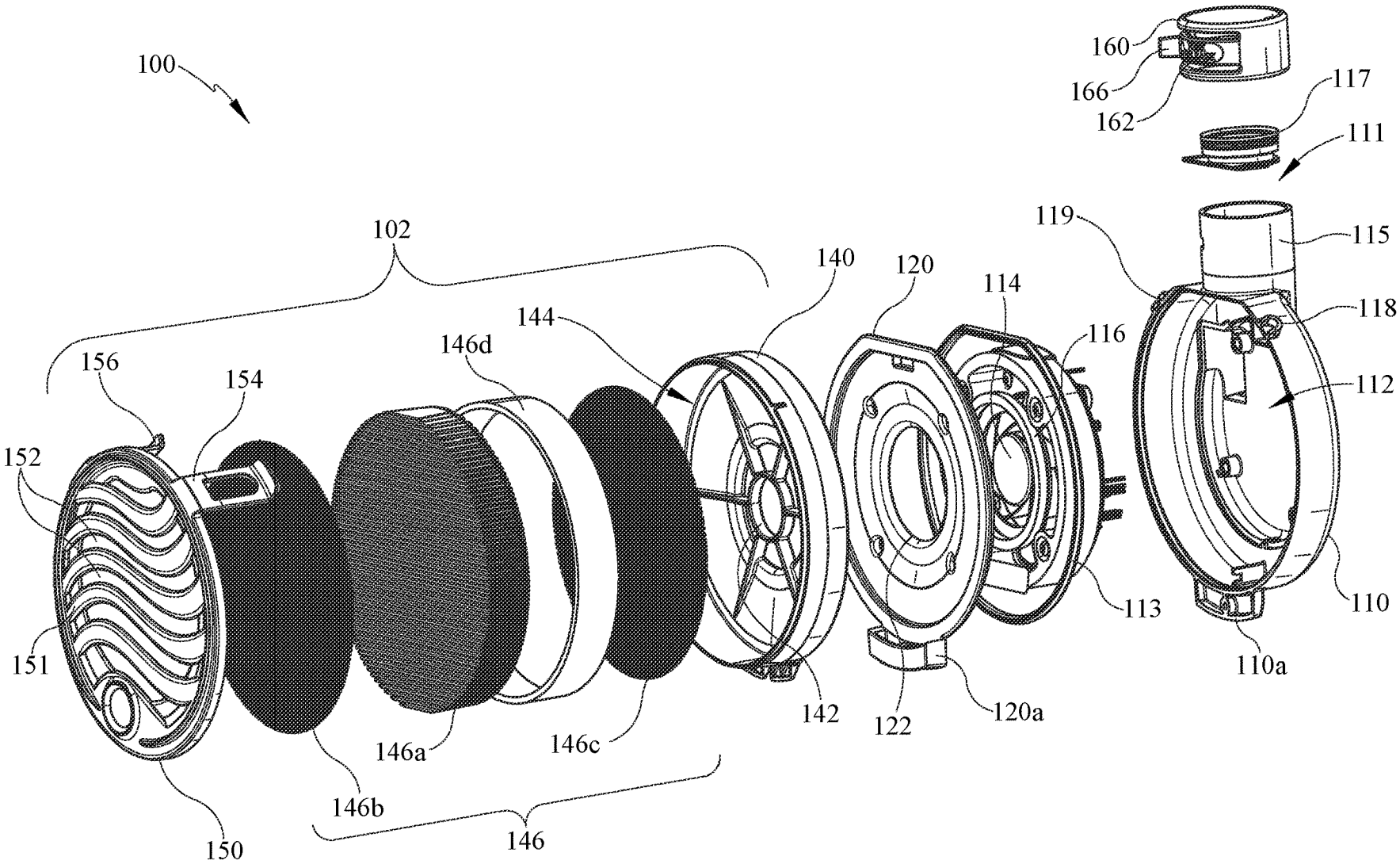
FIG. 4 is an exploded perspective view of the blower assembly of the PAPR carriage and assembly of FIG. 1A.

FIG. 4 is an exploded perspective view of the blower assembly 100.

Figure 7:
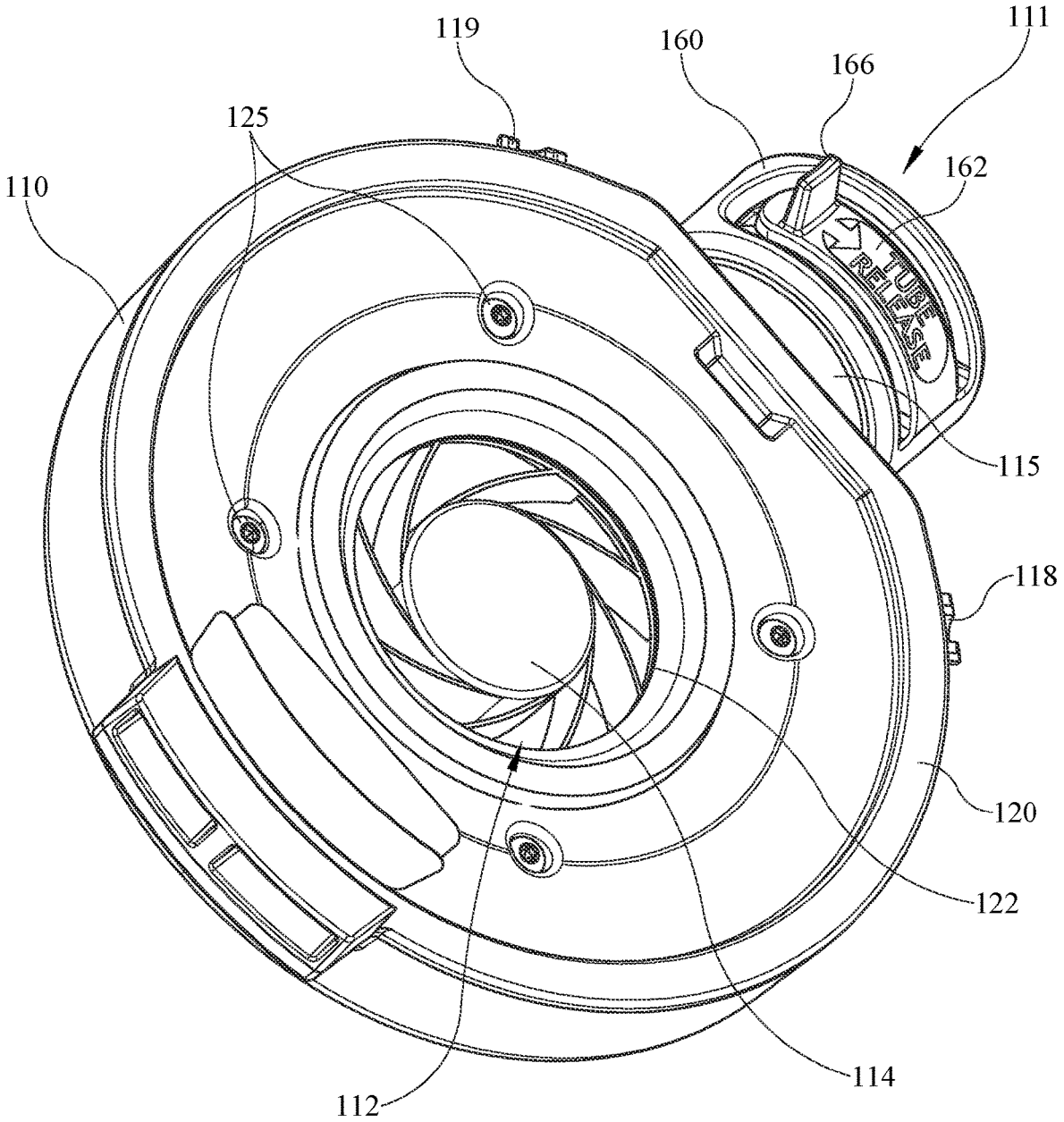
FIG. 7 is another partial perspective view of the exemplary blower assembly of FIG. 4, in which the filter has been hidden from view to better illustrate other components of the exemplary blower assembly.
Figure 8:
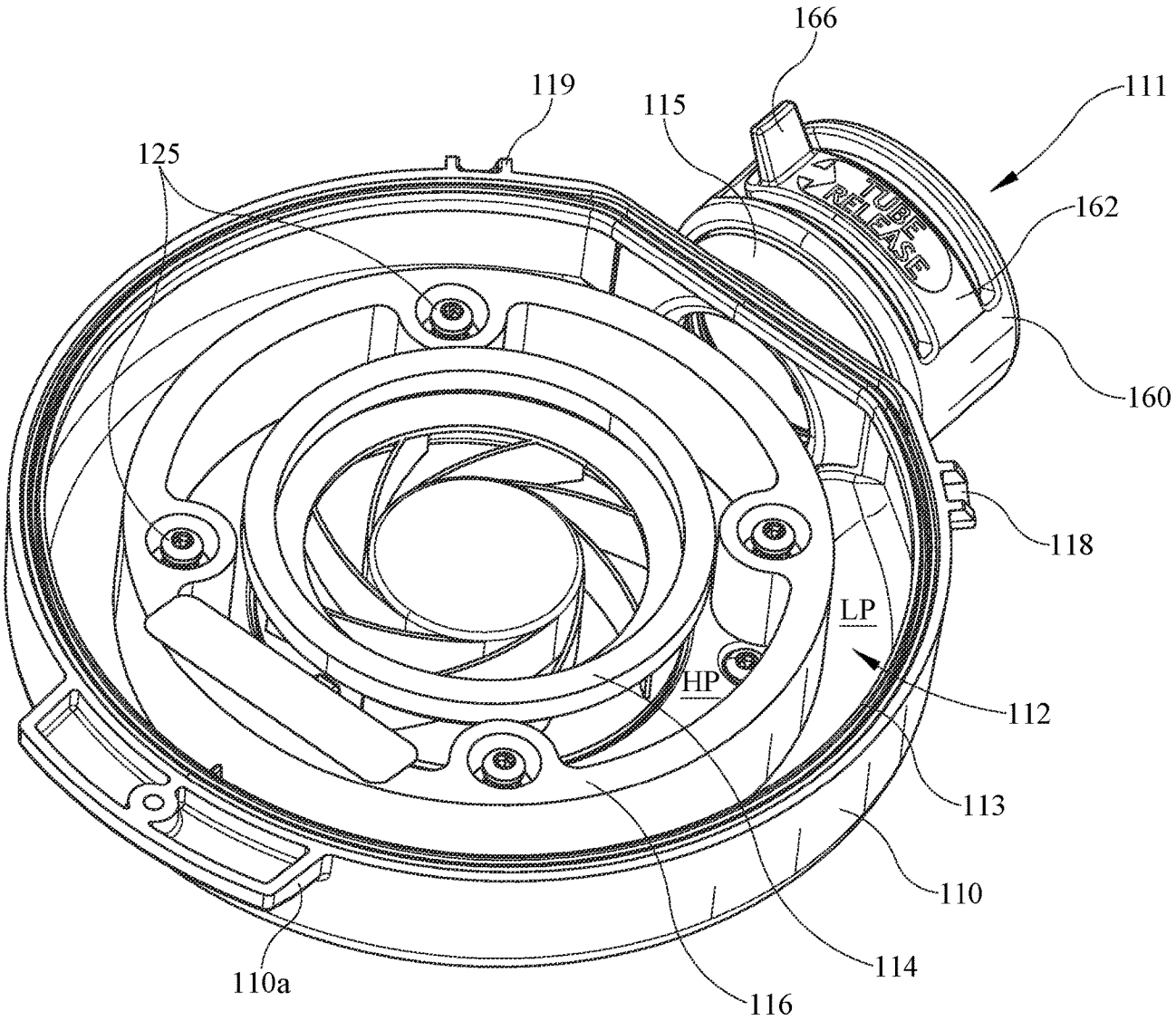
FIG. 8 is another partial perspective view of the exemplary blower assembly of FIG. 4, in which the filter and the upper housing have been hidden from view to better illustrate an interior cavity of the exemplary blower assembly.

FIGS. 7 and 8 are partial perspective views of the blower assembly 100, in which various components have been hidden from view to better illustrate certain features of the blower assembly 100.

Referring now to FIGS. 3, 4, 7, and 8, the blower assembly 100 generally includes: a lower housing 110; an upper housing 120 connected to the lower housing 110, such that the upper housing 120 and the lower housing 110 collectively define a first interior cavity 112; a filter 102 configured to filter ambient air drawn into the blower assembly 100; and a fan 114. The upper housing 120 and the filter 102 define a pathway for a flow of air into the first interior cavity 112, and the fan 114 is positioned in the first interior cavity 112, such that, when the fan 114 is activated, ambient air is drawn into the blower assembly 100 and travels along the pathway defined by the filter 102 and the upper housing 120 into the first interior cavity 112 for subsequent delivery to a user.

Figure 10:
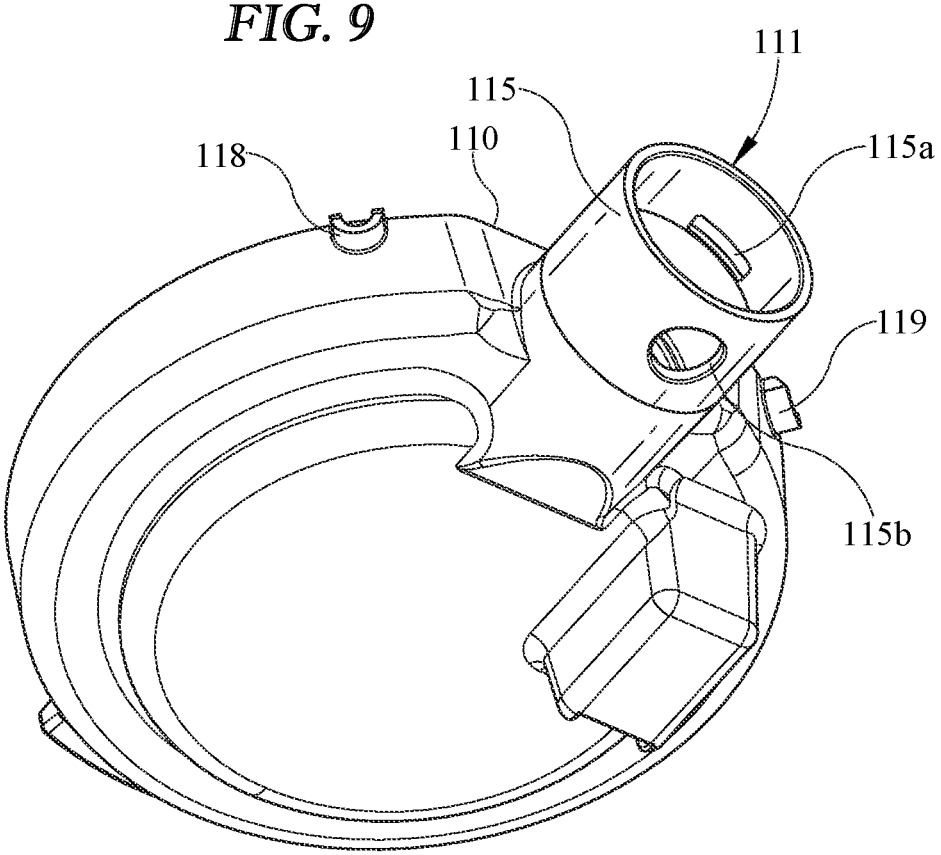
FIG. 10 is a perspective view of a lower housing of the exemplary blower assembly of FIG. 4.

FIG. 10 is a perspective view of the lower housing 110 of the blower assembly 100.

Referring now to FIGS. 1A-B, 2-4, and 10, in this exemplary embodiment, the lower housing 110 defines an outlet port 111 for directing breathable air out of the first interior cavity 112 and into a breathing tube 40 which may be connected thereto, as further described below. In this exemplary embodiment, the lower housing 110 has an exterior surface that is sized and shaped to be received within a cavity defined by a rear portion of the carriage 20 of the PAPR carriage and assembly 10 described above with reference to FIGS. 1A-B and 2. In this regard, and in this exemplary embodiment, the lower housing 110 is shaped and sized such that the lower housing 110 can be selectively snap-fit into a cradle 22 of the carriage 20. To this end, in this exemplary embodiment, the lower housing 110 defines, and thus can be characterized as including, a tubular extension 115 that can be selectively snap-fit into a substantially circular cavity defined by one or more cuffs 24, 26 of the cradle 22. In addition to helping secure the lower housing 110, and thus the blower assembly 100 as a whole, to the cradle 22 of the carriage 20, in this exemplary embodiment, the tubular extension 115 also defines the outlet port 111. Referring now to FIGS. 4, 7, and 8, as noted above, the upper housing 120 is connected to the lower housing 110 to define the first interior cavity 112. In this exemplary embodiment, the first interior cavity 112 is generally cylindrically shaped and has a depth which substantially corresponds to the depth of the fan 114, as best shown in FIG. 8. To enable the fan 114 to draw ambient air through the filter 102 and subsequently into the first interior cavity 112, the upper housing 120 defines, and thus can be characterized as including, a first central opening 122. In this exemplary embodiment, a seal 113 which circumscribes the first interior cavity 112 is provided between the lower housing 110 and the upper housing 120 to prevent air entering the first interior cavity 112 from inadvertently escaping therefrom (i.e., from exiting the first interior cavity 112 by a route other than the outlet port 111). To help maintain the blower assembly 100 within the cradle 22, and thus in association with the carriage 20 of the PAPR carriage and assembly 10, in this exemplary embodiment, the lower housing 110 and the upper housing 120 each define, and thus can be characterized as including, a protrusion 110*a*, 120*a*. When the lower housing 110 and the upper housing 120 are connected, the first protrusion 110*a* and the second protrusion 120*a* collectively define a tab which can be received within a slot 22*a* (FIG. 3) defined by the carriage 20 of the PAPR carriage and assembly 10. In this exemplary embodiment, both the upper housing 120 and a ring 116 (further described below) are connected to the lower housing 110 by a plurality of screws 125, although it should be appreciated that other suitable fasteners or fastening means may alternatively be used without departing from the spirit or scope of the present invention.

Figure 5:
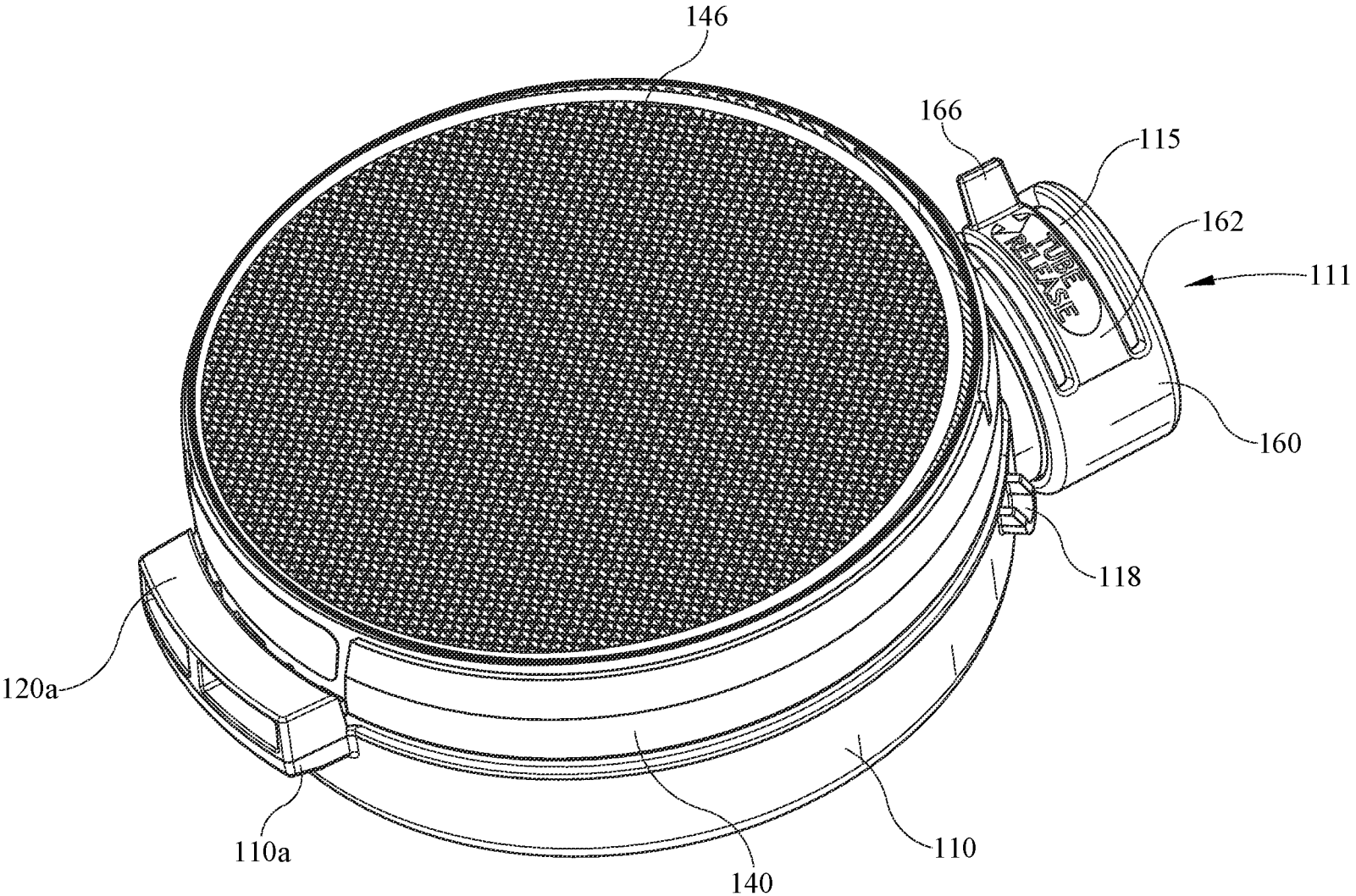
FIG. 5 is a partial perspective view of the exemplary blower assembly of FIG. 4, in which a lid of the filter of the exemplary blower assembly has been hidden from view to better illustrate the filter media.
Figure 6:
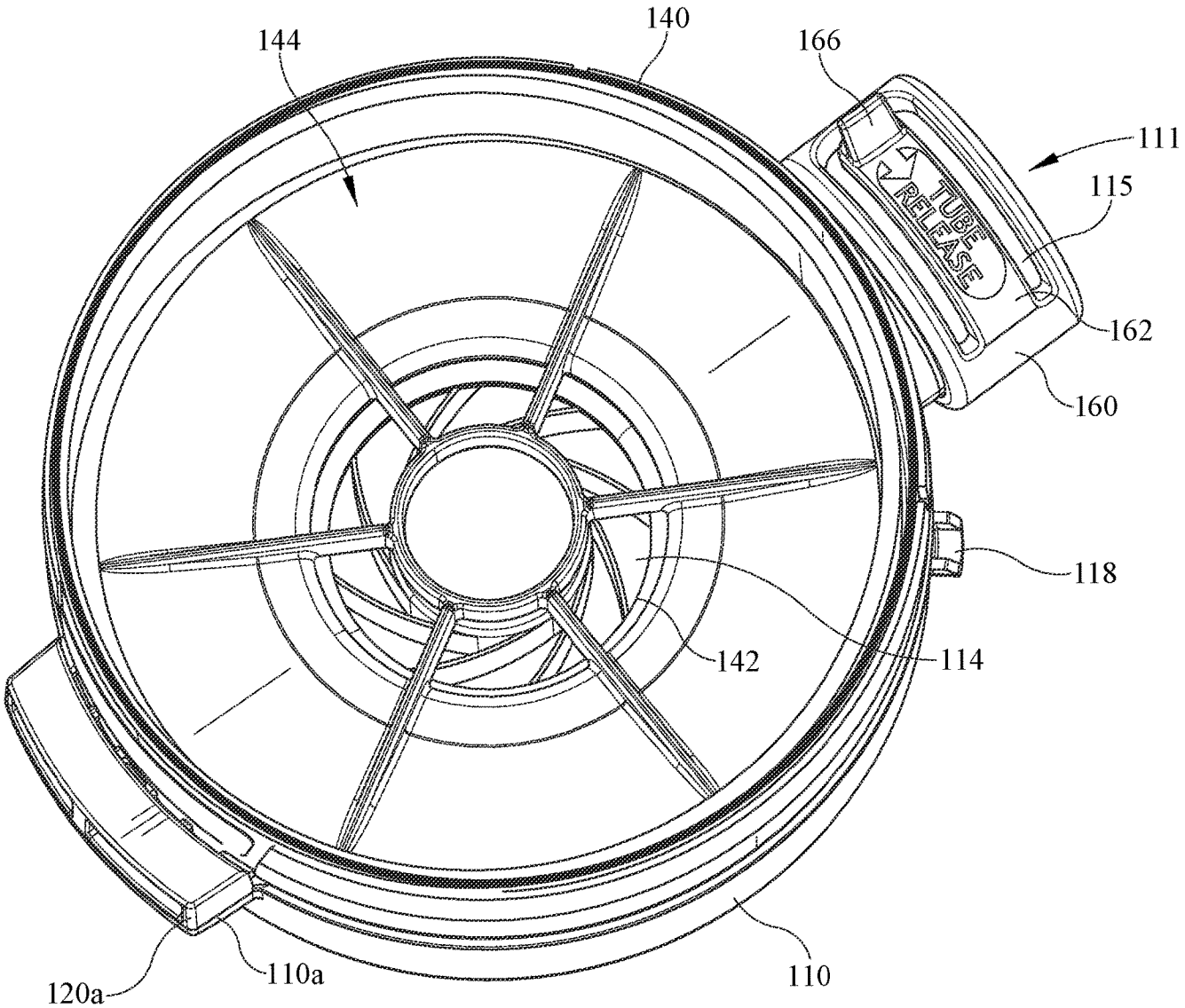
FIG. 6 is another partial perspective view of the exemplary blower assembly of FIG. 4, similar to FIG. 5, but in which the lid and the filter media of the filter have been hidden from view to better illustrate other components of the exemplary blower assembly.

FIGS. 5 and 6 are additional partial perspective views of the blower assembly 100, in which certain components of the blower assembly have been removed to better illustrate certain components of the blower assembly 100.

Referring now to FIGS. 1A-B and 2-8, the filter 102 is removably secured to an external surface of the upper housing 120. In this exemplary embodiment, the filter 102 includes: a frame member 140 that defines a second interior cavity 144; a filter media 146 positioned in the second interior cavity 144; and a lid 150 that partially encloses the second interior cavity 144. In this exemplary embodiment, the frame member 140 is sized and shaped to correspond with that of the upper housing 120, such that the second interior cavity 144, like the first interior cavity 112, is cylindrically shaped. The frame member 140 includes a bottom surface which defines, and thus can be characterized as including, a second central opening 142, which, in this case comprises multiple openings. When the filter 102 is secured to the external surface of the upper housing 120, the second central opening 142 is in registry (i.e., aligned) with the first central opening 122, such that the first central opening 122 and the second central opening 142 define a passageway for air flow into the first interior cavity 112. In this exemplary embodiment, the filter media 146 is comprised of: a filter member 146*a* that is primarily responsible for filtering contaminants within ambient air drawn into the filter 102; a first support member 146*b* that is configured to support and is positioned on one side of the filter member 146*a*; and a second support member 146*c* that is configured to support and is positioned on another side of the filter member 146*a*. It should be appreciated, however, that any number of filter members and/or support members could be utilized without departing from the spirit or scope of the present invention. In this exemplary embodiment, the filter media 146 further includes an insert 146*d* positioned within the second interior cavity 144 to which the filter member 146*a*, the first support member 146*b*, and the second support member 146*c* are bonded or similarly secured. Furthermore, in at least some embodiments, the filter media 146 is constructed to satisfy High Efficiency Particulate Air (HEPA) standards, i.e., the filter 102 is a HEPA filter.

Referring still to FIGS. 1A-B and 2-8, the lid 150 of the filter 102 defines, and thus can be characterized as including, one or more openings 152 that allow air to pass through the lid 150 into the second interior cavity 144, and thus through the filter media 146. Specifically, in this exemplary embodiment, the lid 150 includes a main body 151 with openings 152 (or vents) defined therethrough. In this exemplary embodiment, there are six openings 152 (or vents), with each opening 152 (or vent) effectively extending from one edge of the lid to an opposite edge of the lid along a non-linear (wave-like) path. In other words, in this exemplary embodiment, each opening 152 (or vent) defined by the main body 151 extends between two points on the circumference of the main body 151. The lid 150, in this exemplary embodiment, also defines, and thus can be characterized as including, one or more latches 154, 156 that are used to connect the filter 102 to the lower housing 110. Specifically, in this embodiment, the lid 150 includes two latches 154, 156, which extend outwardly from the main body 151 of the lid 150 and are each configured to engage a respective protrusion 118, 119 provided on an external surface of the lower housing 110.

Referring now specifically to FIG. 8, as noted above, the fan 114, which, in this exemplary embodiment, is a centrifugal fan (or impeller), is positioned within the first interior cavity 112, such that, when the fan 114 is activated, it draws ambient air into the first interior cavity 112 defined by the lower housing 110 and the upper housing 120. Specifically, ambient air drawn into the blower assembly 100 by the fan 114 travels through the one or more openings 152 (or vents) of the lid 150 (FIGS. 1B and 2-4), through the second interior cavity 144 (FIGS. 4 and 6) and thus the filter media 146 (FIGS. 4 and 5) positioned therein to remove contaminants, through the second central opening 142 (FIGS. 4 and 6), through the first central opening 122 (FIGS. 4, 6, and 7), and into the first interior cavity 112 (FIGS. 4 and 8) for subsequent delivery through the outlet port 111 (FIGS. 3-8 and 10). In this way, the blower assembly 100 thus generates breathable air which can be subsequently directed to a headpiece 50 worn by a user via a breathing tube 40 connected to the outlet port 111.

Figure 11:
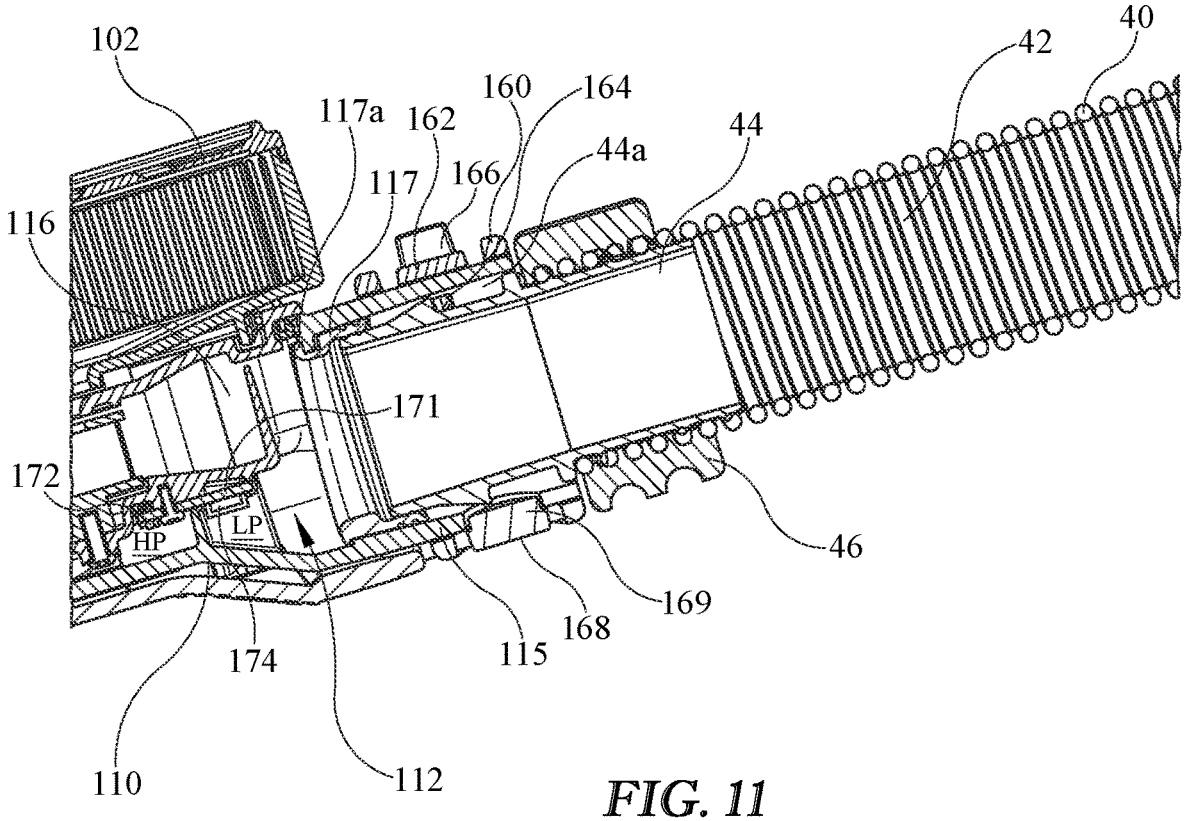
FIG. 11 is a partial side-sectional view of the PAPR carriage and assembly of FIG. 1A, illustrating a connection between the exemplary blower assembly and a breathing tube.

FIG. 11 is a partial side-sectional view of the PAPR carriage and assembly 10 of FIG. 1A.

Referring now to FIGS. 8 and 11, in this exemplary embodiment, a ring 116 is positioned in the first interior cavity 112 defined by the lower housing 110 and the upper housing 120. The ring 116 circumscribes and is at a spaced distance from the fan 114. In this regard, the ring 116 thus bifurcates the first interior cavity 112 into a high-pressure zone (HP) and a low-pressure zone (LP). The high-pressure zone (HP) corresponds to an area of the first interior cavity 112 located inside of the ring 116, and the low-pressure zone (LP) corresponds to an area of the first interior cavity 112 located outside of the ring 116. Accordingly, there is a pressure drop across the ring 116. To enable breathable air drawn into the first interior cavity 112 by the fan 114 to travel from the high-pressure zone (HP) to the low-pressure zone (LP) for subsequent delivery through the outlet port 111, the ring 116 is preferably constructed of a porous material that allows air to pass through it, but suppresses noise generated by the fan 114. In this regard, suitable materials for the ring 116 include various porous plastics, such as polyethylene, ultra-high molecular weight (UHMW) polyethylene, polytetrafluoroethylene (PTFE), or other polymers. For example, in this exemplary embodiment, the ring 116 is constructed of melamine foam with a nominal wall thickness of 0.25 inches and a pore size of 130 microns.

Figure 12:
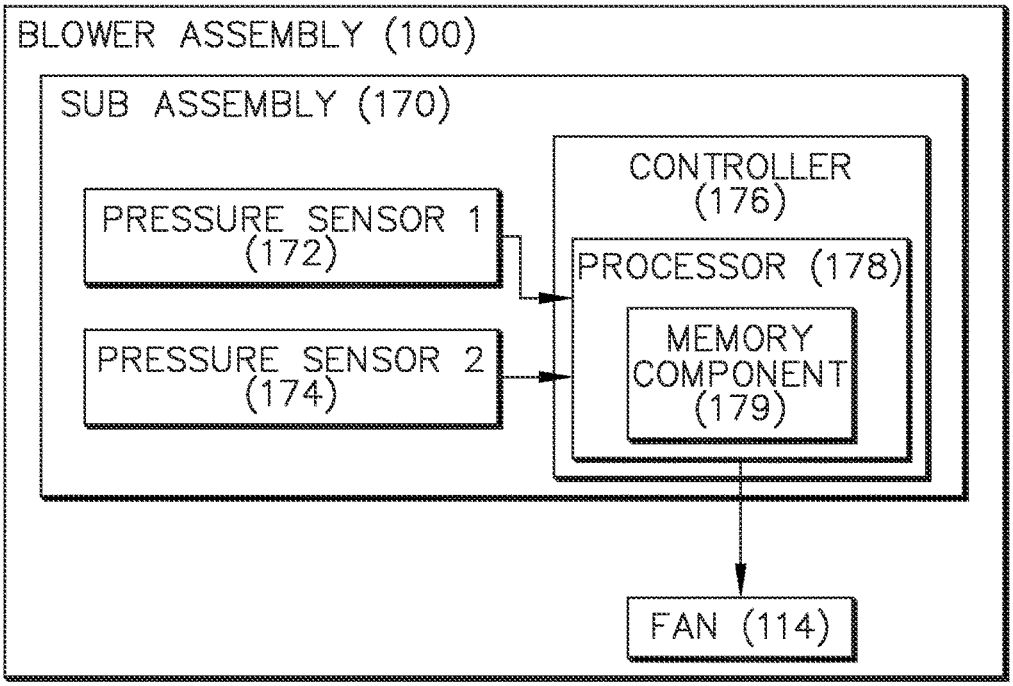
FIG. 12 is a schematic diagram of a subsystem for use in the exemplary blower assembly of FIG. 4.

FIG. 12 is a schematic diagram of a subsystem for use in the exemplary blower assembly 100.

Referring now to FIGS. 11 and 12, in this exemplary embodiment, the blower assembly 100 further includes a subassembly 170 for calculating air flow (i.e., volumetric air flow) within the first interior cavity 112 provided by the blower assembly 100 through the ring 116. The subassembly 170 includes: a first pressure sensor 172, which is positioned and configured to obtain air pressure readings in the high-pressure zone (HP) of the first interior cavity 112; a second pressure sensor 174, which is positioned and configured to obtain air pressure readings in the low-pressure zone (LP) of the first interior cavity 112; and a controller 176, which is operably connected to the first pressure sensor 172 and the second pressure sensor 174. Suitable pressure sensors which may be utilized in the blower assembly 100 include barometric pressure sensors, such as Part No. DPS310 manufactured and distributed by Infineon Technologies AG of Munich, Germany. In this exemplary embodiment, the first pressure sensor 172 and the second pressure sensor 174 are provided on a circuit board 171 and positioned in respective wells (or cavities) located on either side of the ring 116. As shown in FIG. 11, the first pressure sensor 172 is positioned within a well (or cavity) that is located within the high-pressure zone (HP) of the first interior cavity 112, and the second pressure sensor 174 is positioned within a well (or cavity) that is located within the low-pressure zone (LP). In this regard, the first pressure sensor 172 and the second pressure sensor 174 can thus be characterized as being positioned inside and outside of the ring 116, respectively, despite the first pressure sensor 172 and the second pressure sensor 174 both residing on a lower plane than the ring 116. Accordingly, in this exemplary embodiment, the first pressure sensor 172 and the second pressure sensor 174 are positioned outside of the direct path of air flowing to a breathing tube 40 connected to the outlet port 111 of the blower assembly 100. In this exemplary embodiment, the first pressure sensor 172 and the second pressure sensor 174 thus measure static air pressure on either side (i.e., inside and outside) of the ring 116. Furthermore, in this exemplary embodiment, as a result of the dynamics of air flowing out of the blower assembly 100 and into the breathing tube 40, static pressure is scavenged away from the second pressure sensor 174, effectively exaggerating the pressure differential between the first pressure sensor 172 and the second pressure sensor 174.

Referring still to FIGS. 11 and 12, air pressure readings obtained by the first pressure sensor 172 and the second pressure sensor 174 are directed to the controller 176 for subsequent processing. In this regard, the controller 176 includes a processor 178 (which, in some embodiments, may also be resident on a circuit board) that is configured to execute instructions (routines) stored in a memory component 179 or other computer-readable medium. In this exemplary embodiment, the memory component 179 includes instructions, which, when executed by the processor 178, cause the processor 178 to calculate the volumetric air flow within the first interior cavity 112 based on the readings obtained from the first pressure sensor 172 and the second pressure sensor 174. Specifically, in this exemplary embodiment, the memory component 179 includes instructions, which, when executed by the processor 178, cause the processor 178 to calculate the volumetric air flow within the first interior cavity provided by the blower assembly 100 through the ring 116. Use of a first pressure sensor and a second pressure sensor to calculate air flow within a PAPR assembly, but in a different configuration and application, is also described in commonly assigned U.S. patent application Ser. No. 16/599,242, which is incorporated herein by reference.

Referring still to FIGS. 11 and 12, as a further refinement, in this exemplary embodiment, the controller 176 is also operably connected to the fan 114 of the blower assembly, such that the controller 176 can selectively communicate instructions (signals) to adjust the speed of the fan 114 based on the volumetric flow rate calculated from the readings obtained by the first pressure sensor 172 and the second pressure sensor 174. In this regard, the controller 176 may be operably connected to a motor (not shown) of the fan 114. In some implementations, the calculated volumetric flow rate may be compared by the controller 176 against a predetermined, target volumetric flow rate (e.g., against a value stored within the memory component 179 of the controller 176). In such implementations, based on the comparison of the calculated volumetric flow rate against the predetermined, target volumetric flow rate, the controller 176 will then communicate instructions to the fan 114 which cause the fan to increase or decrease in speed to adjust the flow rate toward the predetermined, target volumetric flow rate.

Figure 9:
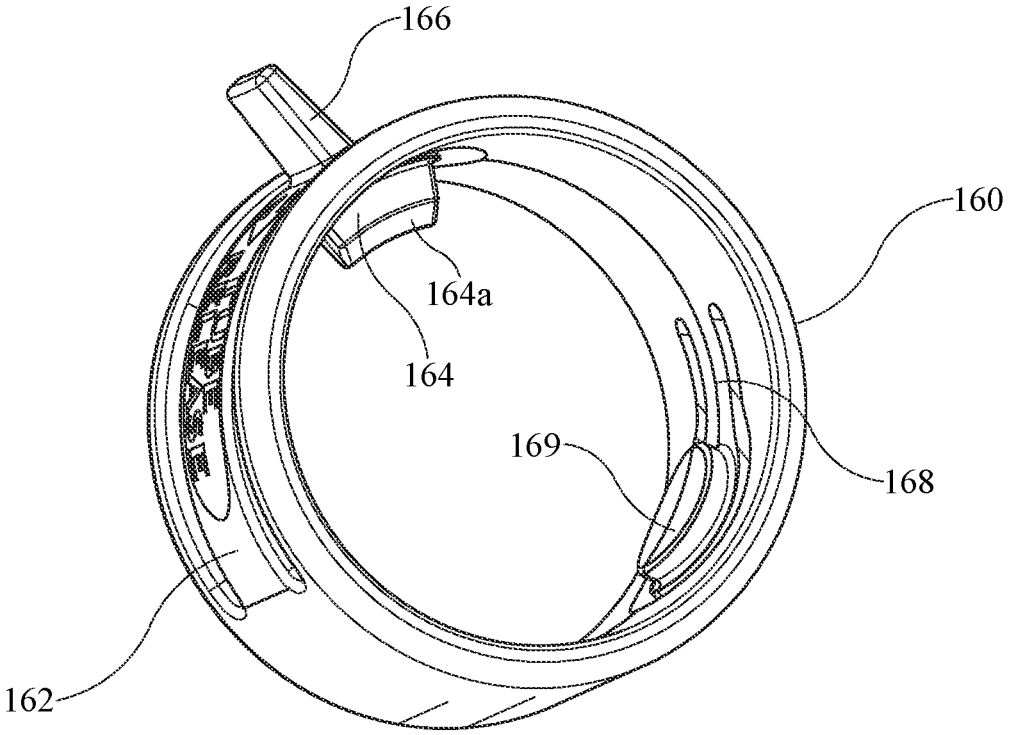
FIG. 9 is a perspective view of a clip of the exemplary blower assembly of FIG. 4.

FIG. 9 is a perspective view of a clip 160 for securing the breathing tube 40 (which is shown in FIG. 3) to the tubular extension 115 of the lower housing 110 of the exemplary blower assembly 100.

FIG. 10 is a perspective view of the lower housing 110 of the blower assembly 100.

Referring now to FIGS. 1A, 1B, and 2-11, in this exemplary embodiment, the blower assembly 100 further includes a clip 160 mounted to the tubular extension 115 of the lower housing 110 to facilitate rapid and simple connection (or disconnection of) the breathing tube 40 of the PAPR carriage and assembly 10. As noted above, breathable air generated by the blower assembly 100 is directed out of the blower assembly 100 and into the breathing tube 40 via the outlet port 111 defined by the lower housing 110, as perhaps best shown in FIG. 8. The tubular extension 115 is sized and shaped to receive a distal end of the breathing tube 40 of the PAPR carriage and assembly 10, which, in this case, is defined by an adapter 44 that is configured for insertion into a main body 42 of the breathing tube 40, as best shown in FIG. 11. The adapter 44 and the main body 42 of the breathing tube 40, in this embodiment, are maintained in association with each other via a clamp 46. The adapter 44 of the breathing tube 40 includes a circumferential groove **44*a* which, when the adapter 44 is advanced a predetermined distance into the outlet port 111, aligns with a first opening 115*a* (slot) defined by the tubular extension 115 of the lower housing 110. The clip 160 includes a first spring finger 162 with an inwardly extending tab 164 located near the distal end of the first spring finger 162. The tab 164 is configured to pass through the first opening 115*a* of the lower housing 110. Thus, when the breathing tube 40 is connected to blower assembly 100, the tab 164 extends into and engages the circumferential groove 44*a* of the adapter 44. The clip 160 also includes an outwardly extending lever 166 located near the distal end of the first spring finger 162. The orientation of the first spring finger 162, tab 164, and lever 166 is such that a force can be applied to the lever 166 to move the tab 164 out of engagement with the circumferential groove 44*a* of the adapter 44 to permit disconnection of the breathing tube 40 from the blower assembly 100**.

Referring now specifically to FIGS. 9-11, in this exemplary embodiment, the clip 160 also includes a second spring finger 168 with an inwardly extending button 169 located at a distal end of the second spring finger 168. The button 169 is configured, when the clip 160 is mounted on the tubular extension 115 of the lower housing 110, to engage a second opening 115*b* defined by the tubular extension 115, and thus assist in aligning the clip 160 with the tubular extension 115. Furthermore, in this exemplary embodiment, the tab 164 of the first spring finger 162 includes a sloped end 164*a* (or lead-in ramp). Accordingly, as the adapter 44 is advanced into the outlet port 111 defined by the tubular extension 115 to connect the breathing tube 40 to the blower assembly 100, the distal end of the breathing tube 40 defined by the adapter 44 engages and effectively pushes the tab 164 of the clip 160 radially outward to permit further advancement of the adapter 44. Once the adapter 44 is advanced a predetermined distance, the tab 164 will extend into and engage the circumferential groove 44*a* of the adapter 44, thereby maintaining the breathing tube 40 within the tubular extension 115 until a user applies a force to the lever 166 to move the tab 164 out of engagement with the circumferential groove 44*a* of the adapter 44.

Referring now specifically to FIGS. 4 and 11, in this exemplary embodiment, the blower assembly 100 also includes a seal 117 that circumscribes the entry into the tubular extension 115 from the first interior cavity 112. As shown in FIG. 11, the seal 117 is configured to receive the adapter 44 defining the distal end of the breathing tube 40 and limits, at least in part, the extent to which the breathing tube 40 can be advanced into the tubular extension 115. As the adapter 44 of the breathing tube 40 is inserted into the seal 117, a seal is created around the circumference of the distal end of the breathing tube 40, further facilitating the connection between the breathing tube 40 and the blower assembly 100. In this exemplary embodiment, the seal 117 extends into the first interior cavity 112 and includes a rim 117*a* with rounded edges (i.e., no sharp edges), thereby providing a smooth transition as breathable air moves from the first interior cavity 112, through the tubular extension 115 and into the breathing tube 40. In this regard, such smooth transition can reduce the energy required to adjust the flow rate toward a predetermined, target volumetric flow rate.

One of ordinary skill in the art will recognize that additional embodiments and implementations are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A blower assembly for a powered air-purifying respirator, comprising:

a lower housing, which defines an outlet port for directing breathable air out of the blower assembly;

an upper housing connected to the lower housing, such that the upper housing and the lower housing collectively define a first interior cavity, the upper housing including a first central opening;

a filter removably secured to the upper housing, the filter including a frame member defining a second interior cavity for receiving a filter media, and a lid including one or more openings that allow air to pass through the lid, wherein a second central opening is defined in a lower surface of the frame member, such that, when the frame member is secured to the upper housing, the second central opening defined in the lower surface of the frame member is in registry with the first central opening of the upper housing, thus defining a passageway for air flow into the first interior cavity;

a fan positioned in the first interior cavity, such that, when the fan is activated, the fan draws ambient air through the one or more openings of the lid, through the second interior cavity, through the second central opening, through the first central opening, and into the first interior cavity for subsequent delivery through the outlet port, and a ring constructed of a porous material and positioned in the first interior cavity, wherein the ring circumscribes the fan and bifurcates the first interior cavity into a first zone located inside of the ring and a second zone located outside of the ring, with air passing from the first zone through the ring to the second zone for subsequent delivery through the outlet port.

2. The blower assembly according to claim 1, wherein the ring is constructed of melamine foam.

3. The blower assembly according to claim 1, wherein the lower housing includes a tubular extension which defines the outlet port, and the blower assembly further comprises a clip mounted to the tubular extension and configured to connect a breathing tube to the tubular extension, wherein the clip can be selectively engaged to disconnect the breathing tube from the tubular extension.

4. The blower assembly according to claim 3, wherein the tubular extension defines one or more openings configured to receiving one or more spring fingers of the clip.

5. The blower assembly according to claim 4, wherein the tubular extension defines a first opening for receiving a tab of a first spring finger of the clip and a second opening for receiving a button of a second spring finger of the clip, and wherein the tab of the first spring finger is configured to engage a circumferential groove defined by the breathing tube.

6. The blower assembly according to claim 5, wherein the first spring finger includes a lever, which, in use, can be selectively engaged to disengage the tab of the first spring finger from the circumferential groove defined by the breathing tube.

7. The blower assembly according to claim 1, and further comprising:

a subassembly, including a first pressure sensor configured to obtain air pressure readings within the first zone of the first interior cavity, a second pressure sensor configured to obtain air pressure readings within the second zone of the first interior cavity, and a controller operably connected to the first pressure sensor and the second pressure sensor, the controller including a processor for executing instructions stored in a memory component to (i) receive and process air pressure readings obtained by the first pressure sensor and the second pressure sensor and (ii) calculate a volumetric air flow within the first interior cavity based on the air pressure readings obtained from the first pressure sensor and the second pressure sensor.

8. The blower assembly according to claim 7, wherein the memory component includes instructions, which, when executed by the processor, cause the controller to selectively communicate instructions to the fan based on the calculated volumetric air flow.

9. The blower assembly according to claim 7, wherein the first pressure sensor and the second pressure sensor are each positioned outside of the direct path of air flowing from the fan to the outlet port, such that in use, a pressure differential, as calculated from the air pressure readings obtained by the first pressure sensor and the second pressure sensor, is exaggerated.

10. The blower assembly according to claim 1, wherein the lower housing includes a tubular extension which defines the outlet port, and further comprising a seal positioned within the tubular extension and configured to receive a distal end of a breathing tube.

11. A blower assembly for a powered air-purifying respirator, comprising:

a lower housing, which defines an outlet port for directing breathable air out of the blower assembly;

an upper housing connected to the lower housing, such that the upper housing and the lower housing collectively define a first interior cavity;

a filter configured to filter ambient air drawn into the blower assembly and removably secured to the upper housing;

a fan; and a ring constructed of a porous material and positioned in the first interior cavity, the ring circumscribing and at a spaced distance from the fan;

wherein the upper housing and the filter define a pathway for a flow of air into the first interior cavity, and the fan is positioned in the first interior cavity, such that, when the fan is activated, the fan draws ambient air along the pathway into the first interior cavity for subsequent delivery through the outlet port; and wherein the ring bifurcates the first interior cavity into a first zone located inside of the ring and a second zone located outside of the ring, with air passing from the first zone through the ring to the second zone for subsequent delivery through the outlet port.

12. The blower assembly according to claim 11, and further comprising:

a subassembly, including a first pressure sensor configured to obtain air pressure readings within the first zone of the first interior cavity, a second pressure sensor configured to obtain air pressure readings within the second zone of the first interior cavity, and a controller operably connected to the first pressure sensor and the second pressure sensor, the controller including a processor for executing instructions stored in a memory component to (i) receive and process air pressure readings obtained by the first pressure sensor and the second pressure sensor and (ii) calculate a volumetric air flow within the first interior cavity based on the air pressure readings obtained from the first pressure sensor and the second pressure sensor.

13. The blower assembly according to claim 12, wherein the memory component includes instructions, which, when executed by the processor, cause the controller to selectively communicate instructions to the fan based on the calculated volumetric air flow.

14. The blower assembly according to claim 12, wherein the first pressure sensor and the second pressure sensor are each positioned outside of the direct path of air flowing from the fan to the outlet port, such that in use, a pressure differential, as calculated from the air pressure readings obtained by the first pressure sensor and the second pressure sensor, is exaggerated.

15. The blower assembly according to claim 11, wherein the filter includes a frame member defining a second interior cavity for receiving a filter media, and a lid including one or more openings that allow air to pass through the lid.

16. The blower assembly according to claim 15, wherein a first central opening is defined in the upper housing, and a second central opening is defined in a lower surface of the frame member, such that, when the frame member is secured to the upper housing, the second central opening defined in the lower surface of the frame member is in registry with the first central opening of the upper housing.

17. A blower assembly for a powered air-purifying respirator, comprising:

a lower housing including a tubular extension, which defines an outlet port for directing breathable air out of the blower assembly;

an upper housing connected to the lower housing, such that the upper housing and the lower housing collectively define a first interior cavity;

a filter configured to filer ambient air drawn into the blower assembly and removably secured to the upper housing;

a fan; and a clip mounted to the tubular extension and configured to connect a breathing tube to the tubular extension;

wherein the upper housing and the filter define a pathway for a flow of air into the first interior cavity, and the fan is positioned in the first interior cavity, such that, when the fan is activated, the fan draws ambient air along the pathway into the first interior cavity for subsequent delivery through the outlet port;

wherein the clip can be selectively engaged to disconnect the breathing tube from the tubular extension and includes one or more spring fingers;

wherein the tubular extension defines one or more openings configured to receive the one or more spring fingers of the clip; and wherein the tubular extension defines a first opening for receiving a tab of a first spring finger of the clip and a second opening for receiving a button of a second spring finger of the clip, and wherein the tab of the first spring finger is configured to engage a circumferential groove defined by the breathing tube.

18. The blower assembly according to claim 17, wherein the first spring finger includes a lever, which, in use, can be selectively engaged to disengage the tab of the first spring finger from the circumferential groove defined by the breathing tube.

19. The blower assembly according to claim 17, and further comprising a seal positioned at a proximal end of the tubular extension and configured to receive a distal end of the breathing tube.

* * * * *